US008873980B2

(12) United States Patent
Fujihara et al.

(10) Patent No.: US 8,873,980 B2
(45) Date of Patent: Oct. 28, 2014

(54) DEVELOPING DEVICE, IMAGE FORMING APPARATUS AND METHOD OF CONTROLLING DEVELOPING DEVICE

(71) Applicant: Kyocera Document Solutions Inc., Osaka (JP)

(72) Inventors: Kensuke Fujihara, Osaka (JP); Akihiro Watanabe, Osaka (JP); Nobuyuki Fuchimoto, Osaka (JP)

(73) Assignee: Kyocera Document Solutions Inc., Osaka (JP)

( * ) Notice: Subject to any disclaimer, the term of this patent is extended or adjusted under 35 U.S.C. 154(b) by 21 days.

(21) Appl. No.: 13/711,799

(22) Filed: Dec. 12, 2012

(65) Prior Publication Data

US 2013/0156454 A1 Jun. 20, 2013

(30) Foreign Application Priority Data

Dec. 16, 2011 (JP) ..... 2011-275917
Nov. 30, 2012 (JP) ..... 2012-262805

(51) Int. Cl.
*G03G 15/06* (2006.01)
*G03G 15/09* (2006.01)

(52) U.S. Cl.
CPC ..... *G03G 15/0907* (2013.01)
USPC ..... 399/55; 399/85; 399/90; 399/258; 399/270

(58) Field of Classification Search
None
See application file for complete search history.

(56) References Cited

U.S. PATENT DOCUMENTS

| | | | | |
|---|---|---|---|---|
| 4,872,100 | A * | 10/1989 | Diaz | 363/41 |
| 6,128,449 | A * | 10/2000 | Zenba et al. | 399/50 |
| 6,282,385 | B1 | 8/2001 | Suto | |
| 6,429,709 | B1 * | 8/2002 | Hall et al. | 327/175 |
| 7,937,008 | B2 * | 5/2011 | Fujishima et al. | 399/49 |
| 2008/0232862 | A1 | 9/2008 | Fujishima et al. | |
| 2009/0028593 | A1 * | 1/2009 | Okumura | 399/55 |
| 2009/0237623 | A1 * | 9/2009 | Yamauchi | 353/85 |
| 2010/0129102 | A1 * | 5/2010 | Fujihara et al. | 399/55 |
| 2010/0195150 | A1 * | 8/2010 | Takahashi et al. | 358/1.15 |
| 2011/0164437 | A1 * | 7/2011 | Sun et al. | 363/16 |
| 2013/0183052 | A1 * | 7/2013 | Tsukada | 399/53 |
| 2013/0259504 | A1 * | 10/2013 | Fujihara | 399/55 |
| 2013/0287415 | A1 * | 10/2013 | Nakagawa | 399/44 |

FOREIGN PATENT DOCUMENTS

| | | |
|---|---|---|
| JP | 2003-270900 A | 9/2003 |
| JP | 2006-221107 | 8/2006 |
| KR | 10-0334109 B1 | 5/2001 |

* cited by examiner

*Primary Examiner* — Clayton E LaBalle
*Assistant Examiner* — Ruifeng Pu
(74) *Attorney, Agent, or Firm* — Morgan, Lewis & Bockius LLP

(57) ABSTRACT

A developing device includes a development roller, a magnetic roller, a transformer, a switching portion, output control portion and a capacitor. The development roller is opposite a photoconductor drum. The magnetic roller performs, with a magnetic brush, the supply of a toner to the development roller and the removal of the toner. The transformer generates an alternating-current voltage applied to the development roller. The switching portion passes and interrupts a current to the transformer. The output control portion stepwise changes, when a duty ratio in switching is changed, the duty ratio a plurality of times from a first duty ratio to a second duty ratio. The capacitor has one end connected to the transformer and the other end connected to the switching portion.

11 Claims, 9 Drawing Sheets

DEVELOPING DEVICE, IMAGE FORMING APPARATUS AND METHOD OF CONTROLLING DEVELOPING DEVICE

This application is based on and claims the benefit of priority from the following Japanese Patent Application, the contents of which are hereby incorporated by reference:

(1) Japanese Patent Application No. 2011-275917 filed on Dec. 16, 2011

(2) Japanese Patent Application No. 2012-262805 filed on Nov. 30, 2012

BACKGROUND

The present disclosure relates to a developing device that uses a toner to develop an electrostatic latent image and an image forming apparatus that includes such a developing device. The present disclosure also relates to a method of controlling a developing device.

In some of image forming apparatuses such as a multifunctional peripheral, a copying machine, a printer and a facsimile machine, a toner is used to develop and print an electrostatic latent image. In some of image forming apparatuses, a developer (so-called two-component developer) is used that contains a carrier formed with a magnetic material and a toner. When a two-component developer is used, it is not preferable, in terms of image quality and the like, to bring the magnetic brush produced by a carrier into direct contact with a photoconductor drum. Hence, an image forming apparatus is provided that has a developing device using a method (also referred to a "touchdown development" or a "hybrid development") in which a development roller is provided opposite the photoconductor drum to bear the toner, the magnetic brush is formed with a magnetic roller opposite the development roller, the magnetic brush transfers only the toner to the development roller and an electrostatic latent image is developed without the magnetic brush being pressed onto the photoconductor drum. This method is advantageous, in various respects such as image quality, a printing speed, the life of the toner and the prevention of scattering of the carrier, over a one-component development method or a conventional two-component development method.

For example, an image formation method and an image forming apparatus are known in which a development roller that forms a thin layer of a toner on a surface thereof and a magnetic roller that feeds, with a magnetic carrier, the toner to the development roller are used, and in which electrostatic latent images are developed one after another with the development roller to perform image formation on sheets.

In the touchdown development method as described above, an alternating-current voltage (having a peak-to-peak voltage of, for example, about 1 to 2 kV) is applied to the development roller. Then, the charged toner is blown from the development roller to develop the electrostatic latent image. It is likely that a switching element such as a transistor is used to input signals indicating the turning on and off of energization to a transformer, and that an alternating-current voltage which is applied to the development roller is obtained.

Here, it is likely that, in order to prevent the occurrence of a leak between the photoconductor drum and the development roller (to prevent the occurrence of an electrical discharge) and prevent the occurrence of unevenness in the toner image, it is desirable to be able to change a duty ratio in the switching according to the state of the image forming apparatus (according to the mode). However, the change of the duty ratio in the switching causes an unbalanced voltage (a voltage whose energy is unevenly distributed) to be applied to the transformer, and this results in the occurrence of asymmetric magnetization in the transformer.

Then, when the asymmetric magnetization occurs to displace a magnetic flux, the transformer is brought into a state where the transformer appears to be biased by a direct current. A current (overcurrent) higher than a rating is passed, and thus it is more likely that the switching element is damaged. In particular, as the amount of instantaneous change in the duty ratio is increased, a larger amount of asymmetric magnetization occurs. For example, an alternating-current voltage is applied to the transformer with the asymmetric magnetization occurring, and thus magnetic saturation occurs. Hence, the impedance of the transformer is significantly reduced, with the result that a relatively large current may flow through the switching element. Therefore, when the duty ratio is changed, it is disadvantageously necessary to prevent the passage of a current large enough to cause the damage of the switching element.

As a conventionally known developing device, the fast-speed small hybrid developing device described above is present. However, no consideration is given to the possibility that, when the duty ratio is changed, a large current flows through the switching element. Therefore, it is impossible to solve the above problem with the conventional technology.

SUMMARY

To overcome the above problem, a developing device according to a first aspect of the present disclosure includes a development roller, a magnetic roller, a transformer, a switching portion, a output control portion and a capacitor. The development roller carries a toner and is opposite a photoconductor drum. The magnetic roller is arranged opposite the development roller and performs, with a magnetic brush, the supply of the toner to the development roller and the removal of the toner from the development roller. The transformer generates an alternating-current voltage applied to the development roller. The switching portion passes and interrupts a current to the transformer. The output control portion stepwise changes the duty ratio a plurality of times from the first duty ratio to the second duty ratio, when a duty ratio in switching performed by the switching portion is changed from a first duty ratio to a second duty ratio. The capacitor has one end connected to the transformer and the other end connected to the switching portion.

A method of controlling developing device according to a second aspect of the present disclosure includes; generating, by a transformer, an alternating-current voltage applied to the development roller passing and interrupting, by switching of a switching portion, a current to the transformer; and stepwise changing, when a duty ratio in switching performed by the switching portion is changed from a first duty ratio to a second duty ratio, the duty ratio a plurality of times from the first duty ratio to the second duty ratio.

Further features and advantages of the present disclosure will become apparent from the description of embodiments given below.

DETAILED DESCRIPTION

An embodiment of the present disclosure will be described below with reference to FIGS. 1 to 9. In the following description, an electrophotographic tandem printer 100 (corresponding to an image forming apparatus) including a developing device 1 is taken as an example. Individual elements such as configurations and arrangements described in the present embodiment are not intended to limit the scope of the disclosure and are simply illustrative examples.

(Outline of the Image Forming Apparatus)

Figure 1:
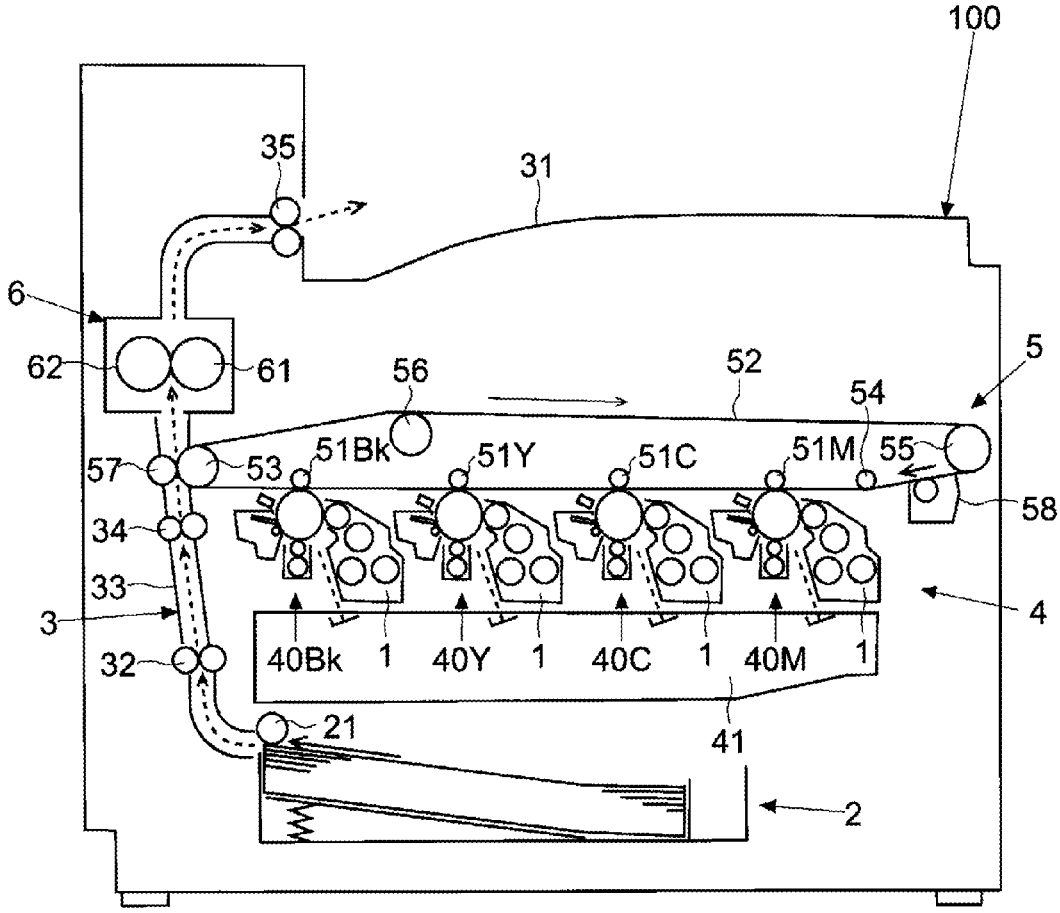
FIG. 1 is a cross-sectional view showing the configuration of a printer.
Figure 2:
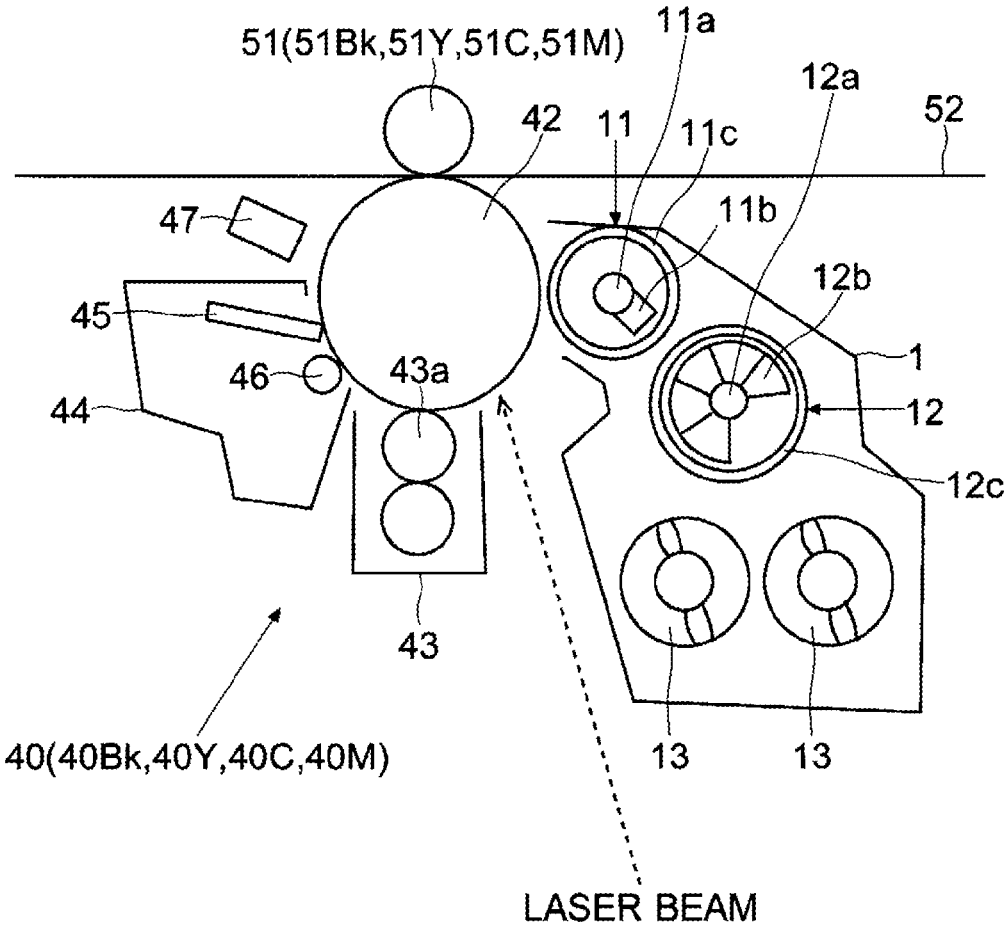
FIG. 2 is a cross-sectional view of an image formation unit.

The outline of the printer 100 according to the embodiment will first be described with reference to FIGS. 1 and 2. FIG. 1 is a cross-sectional view showing the configuration of the printer 100. FIG. 2 is a cross-sectional view of an image formation unit 40.

As shown in FIG. 1, the printer 100 of the present embodiment includes, within its main body, a paper feed portion 2, a transport portion 3, an image formation portion 4, an intermediate transfer portion 5 and a fixing portion 6.

The paper feed portion 2 accommodates various types of sheets such as plain paper (OA paper), OHP sheets and label sheets. In the paper feed portion 2, a paper feed roller 21 is provided that is rotated by a drive mechanism (not shown) such as a motor and that feeds sheets one by one to the transport portion 3. The transport portion 3 guides the sheet supplied from the paper feed portion 2 to an ejection tray 31 through the intermediate transfer portion 5 and the fixing portion 6. In the transport portion 3, there are provided a transport roller pair 32, a guide 33, a resist roller pair 34 that places the transported sheet on standby before the intermediate transfer portion 5 and that feeds it out with appropriate timing, an ejection roller pair 35 and the like.

The image formation portion 4 forms a toner image based on image data on an image to be formed. The image formation portion 4 includes image formation units 40Bk to 40M and an exposure device 41. Specifically, the image formation portion 4 includes the image formation unit 40Bk that forms a black image, the image formation unit 40Y that forms a yellow image, the image formation unit 40C that forms a cyan image and the image formation unit 40M that forms a magenta image.

The image formation units 40Bk to 40M will be described with reference to FIG. 2. Although toner images formed by the image formation units 40Bk to 40M differ in color, they basically have the same configuration. Hence, in the following description, the image formation unit 40Bk is taken as an example, and symbols Bk, Y, C and M indicating the colors are omitted unless a description is given of the symbols. Common members will be described with common symbols in the image formation unit 40.

The image formation unit 40 includes a photoconductor drum 42. The photoconductor drum 42 is rotatably supported. The photoconductor drum 42 receives the drive force of a motor 74 (see FIG. 3), and is driven to rotate at a predetermined circumferential speed. For example, the photoconductor drum 42 has a metal such as aluminum as a base member, and has a photosensitive layer formed of OPC (which may be amorphous silicon) on the outer circumferential surface. The photoconductor drum 42 is subjected to the processes of charging, exposure and development, and thus bears the toner image on the circumferential surface (an image bearing member). The photoconductor drum 42 of the present embodiment is positively charged. Hence, a positively charged toner is used.

A charging device 43 of the image formation unit 40 includes a charging roller 43*a*. The charging roller 43*a* is in contact with the corresponding photoconductor drum 42. A voltage for charging the photoconductor drum 42 is applied to the charging roller 43*a*. Then, the charging device 43 charges the surface of the photoconductor drum 42 at a given potential. The charging device 43 may be a corona charge-type charging device or may be a charging device that uses a brush or the like to charge the photoconductor drum 42.

The exposure device 41 below the image formation units 40 outputs laser light toward the photoconductor drums 42. The exposure device 41 includes, therewithin, optical members such as a semiconductor laser device (laser diode), a polygon mirror, a polygon motor, an fθ lens and a mirror (not shown). The exposure device 41 uses these optical members and thereby applies, to the charged photoconductor drums 42, a light signal (the laser light, represented by a broken line) based on an image signal obtained by subjecting the image data to color removal. The exposure device 41 performs scanning exposure on the photoconductor drums 42, and thereby forms an electrostatic latent image on the circumferential surface of the photoconductor drums 42. Specifically, the photoconductor drums 42 of the present embodiment are positively charged, and the portion to which the light is applied is decreased in potential. The positively charged toner is adhered to the portion of the photoconductor drum 42 where the potential is decreased. An exposure device 41, such as one using an array of LEDs, that uses a method other than the laser method may be used.

The developing device 1 of the image formation unit 40 accommodates a developer (so-called two-component developer) that contains the toner and a carrier formed of a magnetic material. The developing device 1 of the image formation unit 40Bk accommodates a black developer; the developing device 1 of the image formation unit 40Y accommodates a yellow developer; the developing device 1 of the image formation unit 40C accommodates a cyan developer; and the developing device 1 of the image formation unit 40M accommodates a magenta developer. The developing device 1 is connected to a container (not shown) that accommodates the developer; as the toner is consumed, the toner is replenished to the developing device 1.

The developing device 1 includes a development roller 11, a magnetic roller 12 and transport members 13. The development roller 11 is opposite the corresponding photoconductor drum 42; their shaft lines are made parallel to each other. Between the development roller 11 and the corresponding photoconductor drum 42, a gap (space) is provided. The gap is designed to have a predetermined length (1 mm or less).

When printing is performed, a thin layer of the toner is formed on the circumferential surface of the development roller 11. The development roller 11 bears the charged toner. In order for the toner to be blown toward the photoconductor drum 42 to develop the electrostatic latent image, a voltage is applied to the development roller 11 (see FIG. 4 and the like; the details of which will be described later).

The magnetic roller 12 of the developing device 1 is opposite the corresponding development roller 11, and their shaft lines are made parallel to each other. In order to perform the supply of the toner to the development roller 11 and the removal of the toner from the developing roller 11, a voltage is applied to the magnetic roller 12 (see FIG. 4 and the like; the details of which will be described later).

In the developing device 1 of the present embodiment, the two transport members 13 are provided. The transport members 13 are provide below the magnetic roller 12. The directions of rotation of the two transport members 13 differ from each other. For example, the transport members 13 have helical blades, and transport the developer containing the toner and carrier while agitating it. The toner is charged by friction with the carrier caused by the transport.

The roller shaft 11*a* of the development roller 11 and the roller shaft 12*a* of the magnetic roller 12 are fixed and supported by shaft support members (not shown) or the like. A magnet 11*b* which extends in the direction of the shaft line and whose cross section is substantially rectangular is attached to the roller shaft 11*a* of the development roller 11. A magnet 12*b* which extends in the direction of the shaft line and whose cross section is substantially fan-shaped is also attached to the roller shaft 12*a* of the magnetic roller 12. The development roller 11 and the magnetic roller 12 respectively have cylindrical sleeves 11*c* and 12*c* that cover the magnet 11*b* and the magnet 12*b*. The sleeves 11*c* and 12*c* are rotated by the unillustrated drive mechanism.

In the magnet 11*b* of the development roller 11 and the magnet 12*b* of the magnetic roller 12, their opposite polarities face each other in the position where the development roller 11 is opposite the magnetic roller 12. Thus, between the development roller 11 and the magnetic roller 12, a magnetic brush produced by the carrier of the magnetic material is formed. The rotation of the sleeve 12*c* of the magnetic roller 12 bearing the magnetic brush, the application of a voltage to the magnetic roller 12 and the like allow the supply of the toner to the development roller 11, and the thin layer of the toner is formed on the development roller 11. The magnetic brush separates and collects the toner left on the surface of the development roller 11.

A cleaning device 44 cleans the photoconductor drum 42. Each cleaning device 44 extends in the direction of the shaft line of the photoconductor drum 42, and includes a blade 45 formed of resin and a scrubbing roller 46 that scrubs the surface of the photoconductor drum 42 to remove the toner left and the like. The blade 45 and the scrubbing roller 46 are pressed onto the photoconductor drum 42 to scratch out and remove stains such as the residue toner on the photoconductor drum 42. Above the cleaning device 44, a neutralization device 47 (for example, an array of LEDs) is provided that applies light to the photoconductor drum 42 to neutralize static charge.

With reference back to FIG. 1, the description will be continued. The intermediate transfer portion 5 receives the primary transfer of the toner images from the photoconductor drums 42, and performs the secondary transfer onto the sheet. The intermediate transfer portion 5 includes a plurality of primary transfer rollers 51Bk to 51M, an intermediate transfer belt 52, a drive roller 53, driven rollers 54 to 56, a secondary transfer roller 57 and a belt cleaning device 58.

The intermediate transfer belt 52 is formed of a dielectric resin or the like. The intermediate transfer belt 52 is laid, in a tensioned state, over the primary transfer rollers 51Bk to 51M, the drive roller 53 and the driven rollers 54 to 56. The drive rotation of the drive roller 53 connected to the drive mechanism (not shown) such as the motor 74 causes the intermediate transfer belt 52 to rotate in a clockwise direction of the plane of FIG. 1. The primary transfer rollers 51Bk to 51M and the photoconductor drums 42 corresponding to the primary transfer rollers 51Bk to 51M nip the seamless intermediate transfer belt 52 therebetween. A voltage for performing the primary transfer is applied to each of the primary transfer rollers 51Bk to 51M. The toner images (the individual colors of black, yellow, cyan and magenta) formed on the image formation units 40 are sequentially superimposed on each other without displacement, and are primarily transferred to the intermediate transfer belt 52.

The drive roller 53 and the secondary transfer roller 57 nip the intermediate transfer belt 52 to form a nip (secondary transfer portion). A predetermined voltage is applied to the secondary transfer roller 57. The toner image on the intermediate transfer belt 52 obtained by superimposing the individual colors is secondarily transferred to the sheet. The toner and the like left on the intermediate transfer belt 52 after the second transfer are removed by the belt cleaning device 58 and are collected.

The fixing portion 6 is arranged on the downstream side of the sheet transport direction with respect to the secondary transfer portion. The fixing portion 6 includes a fixing roller 61 that incorporates a heating source and a pressurization roller 62 that is pressed onto the fixing roller 61. The fixing portion 6 passes the sheet having the toner image transferred through the nip between the fixing roller 61 and the pressurization roller 62. When the sheet is passed through the nip, the toner image is heated and pressurized, with the result that the toner image is fixed onto the sheet. The sheet after the fixing is ejected into the ejection tray 31, and the printing of one sheet is completed.

(Hardware Configuration of the Printer 100)

Figure 3:
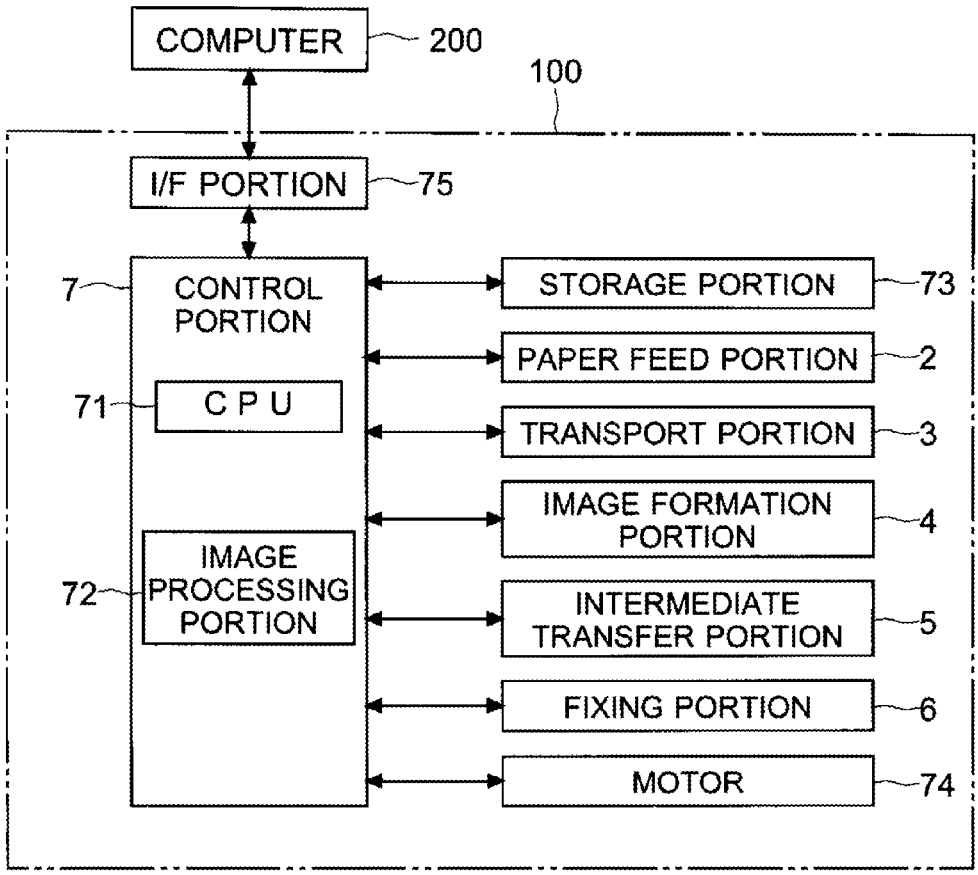
FIG. 3 is a block diagram showing the hardware configuration of the printer.

The hardware configuration of the printer 100 according to the embodiment will now be described with reference to FIG. 3. FIG. 3 is a block diagram showing the hardware configuration of the printer 100.

As shown in FIG. 3, the printer 100 according to the present embodiment includes a control portion 7. The control portion 7 controls the individual portions of the device. The control portion 7 includes a CPU 71 and circuits and elements, such as an image processing portion 72, that perform processing. A storage portion 73 is provided in the printer 100. The storage portion 73 is a combination of nonvolatile and volatile storage units such as a ROM, a RAM and a flash ROM. Although, in the present embodiment, an example where the control portion 7 controls the printing is described, a plurality of types of portions (substrates) that perform control according to the function and role, such as an engine control portion controlling a part performing the printing and a main control portion performing overall control and image processing may be divided and provided.

The CPU 71 is a central processing unit, and performs control on the individual portions of the printer 100 and computation based on a control program stored in the storage portion 73 and being decompressed. The storage portion 73 can store not only the control program for the printer 100 but also various types of data such as control data. Furthermore, even programs and data on the voltage application settings on the development roller 11 and the magnetic roller 12, such as a duty ratio in the application of a voltage to the development roller 11 and the magnetic roller 12 and the setting value of a direct-current bias voltage, are stored in the storage portion 73.

The control portion 7 is connected to the paper feed portion 2, the transport portion 3, the image formation portion 4, the intermediate transfer portion 5, the fixing portion 6 and the like, and controls the operations of individual portions such that appropriate image formation is performed based on the control program and data in the storage portion 73. The control portion 7 also controls one or a plurality of motors 74 provided within the printer 100. The control portion 7 rotates the motor 74 to rotate various rotary members such as the photoconductor drum 42, the development roller 11 and the magnetic roller 12. By the utilization of the drive of the motor 74 described above, the sleeves of the development roller 11 and the magnetic roller 12 are rotated.

A computer 200 (such as a personal computer) is connected through an I/F portion 75 (interface portion) to the control portion 7. The computer 200 is an original portion that transmits printing data including a piece of data instructing the printer 100 to perform the printing. For example, the printing data includes setting data on the printing and image data. Based on the received printing data, the control portion 7 makes the image processing portion 72 perform image processing, and generates image data for the exposure device 41. The exposure device 41 receives the image data and forms the electrostatic latent image on the photoconductor drum 42.

(Application of a Voltage in the Developing Device 1)

Figure 4:
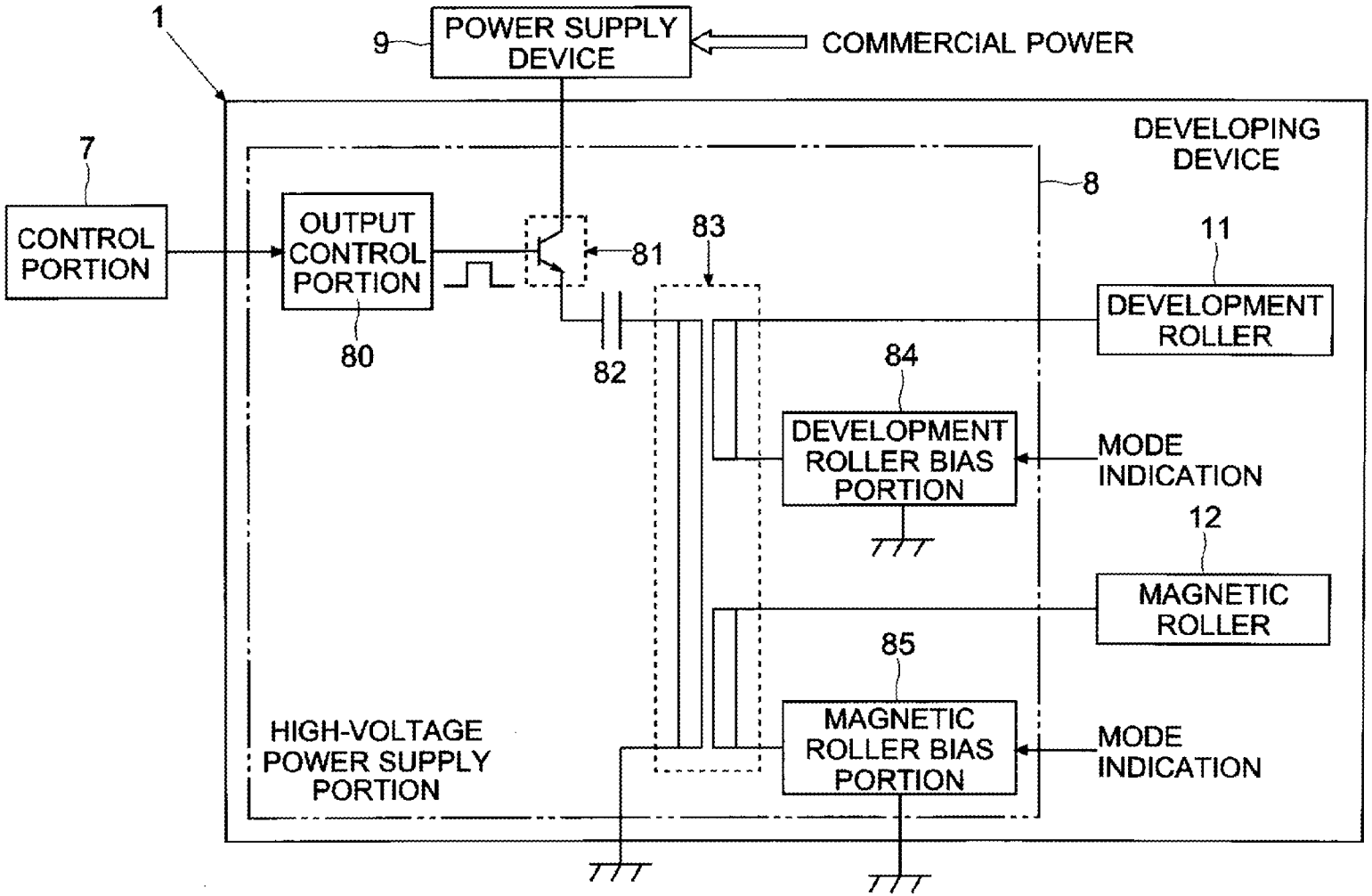
FIG. 4 is a block diagram showing a developing device.

The application of a voltage in the developing device 1 will now be described with reference to FIG. 4. FIG. 4 is a block diagram showing the developing device 1.

As described above, in the developing device 1 of the present embodiment, the development roller 11 and the magnetic roller 12 are provided. In order to perform the development of the electrostatic latent image with the toner, the supply of the toner to the development roller 11 and the removal of the toner from the development roller 11, a voltage is applied to the development roller 11 and the magnetic roller 12. In other words, in order to appropriately move the toner, a voltage is applied to the development roller 11 and the magnetic roller 12.

The developing device 1 includes a high-voltage power supply portion 8 for applying a voltage to the development roller 11 and the magnetic roller 12. The high-voltage power supply portion 8 steps up a voltage to be supplied, and applies (outputs) the voltage to the development roller 11 and the magnetic roller 12.

The high-voltage power supply portion 8 of the present embodiment includes a transistor 81 (an npn type, which corresponds to a switching portion), a capacitor 82, a transformer 83, a development roller bias portion 84, a magnetic roller bias portion 85 and an output control portion 80. Since the timing when each developing device 1 starts and completes the development differs, one high-voltage power supply portion 8 is provided for one developing device 1 (for one combination of the development roller 11 and the magnetic roller 12).

The collector of the transistor 81 is connected to a power supply device 9. The power supply device 9 is provided within the printer 100; commercial power is input thereto. The power supply device 9 performs rectification, smoothing and the like to output a direct-current voltage. For example, the power supply device 9 outputs a voltage of DC 24 volts and applies it to the transistor 81.

The output control portion 80 is connected to the base of the transistor 81. The output control portion 80 inputs a clock signal to the base of the transistor 81. The output control portion 80 switches the transistor 81 with the clock signal. The switching frequency of the transistor 81 by the output control portion 80 may be fixed. The switching frequency can be set at about a few thousand hertz (about 3 to 5 kHz).

The emitter of the transistor 81 is connected to the capacitor 82. The capacitor 82 is connected to the primary side of the transformer 83. The capacitor 82 inputs, to the transformer 83, a signal (voltage) obtained by removing a direct-current component from a waveform obtained by amplifying the clock signal output by the output control portion 80. In other words, an alternating-current waveform is input to the transformer 83.

The transformer 83 outputs a voltage obtained by stepping up the voltage input to the primary side. The secondary side has the outputs of at least two systems, and one is connected to the development roller 11 and the other is connected to the magnetic roller 12. The individual outputs may differ in the stepping-up ratio. In the output on the side of the development roller 11, the development roller bias portion 84 that biases an alternating-current voltage applied to the development roller 11 is provided. Likewise, in the output on the side of the magnetic roller 12, the magnetic roller bias portion 85 that biases an alternating-current voltage applied to the magnetic roller 12 is provided. The alternating-current voltage that is biased with a direct-current voltage by the development roller bias portion 84 is applied to the development roller 11. The alternating-current voltage that is biased with a direct-current voltage by the magnetic roller bias portion 85 is applied to the magnetic roller 12.

The development roller bias portion 84 and the magnetic roller bias portion 85 are a converter that receives the output voltage of the power supply device 9 to step up a voltage. The development roller bias portion 84 and the magnetic roller bias portion 85 are a circuit that can change the output. In other words, the development roller bias portion 84 and the magnetic roller bias portion 85 can change the magnitude of a voltage to be biased.

(Mode of Voltage Application in the Developing Device 1)

Figure 5:
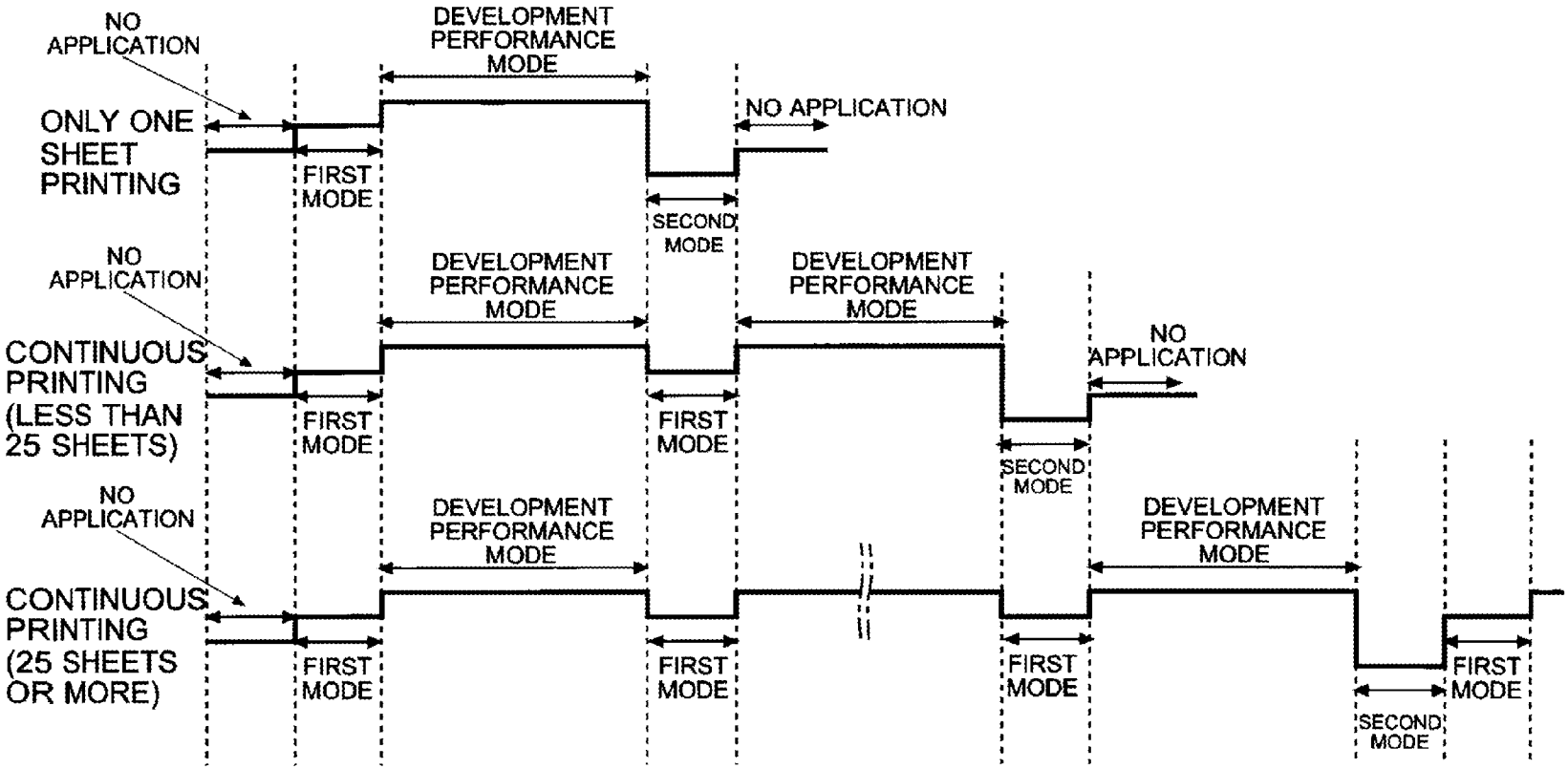
FIG. 5 is a diagram illustrating the transition of the mode of voltage application.

A mode of voltage application in the developing device 1 of the present embodiment will now be described with reference to FIG. 5. FIG. 5 is a diagram illustrating the transition of the mode of voltage application.

The developing device 1 of the present embodiment has, as modes, a development performance mode in which the electrostatic latent image is developed with the toner and a development nonperformance mode in which the electrostatic latent image is not developed. The development nonperformance mode includes a first mode and a second mode. The high-voltage power supply portion 8 changes, according to the mode, the magnitude of the direct-current voltage (bias) applied to the development roller 11 and the magnetic roller 12 and the duty ratio of the switching of the transistor 81. When the printing is not performed, it is not necessary to apply a voltage to the development roller 11 and the magnetic roller 12. Hence, as the state (mode) of the developing device 1, not only the three modes (the development performance mode, the first mode and the second mode) described above but also the state of no application where a voltage is not applied to the development roller 11 and the magnetic roller 12 is present.

The development performance mode is a mode used when the electrostatic latent image on the photoconductor drum 42 is developed while the toner is replenished to the development roller 11 and the toner is blown. The first mode (one type of development nonperformance mode) is a mode used before transfer to the development performance mode and is a mode in which the toner is supplied to the development roller 11 to make appropriate the thin layer of the toner on the surface (sleeve 11*c*) of the development roller 11. The second mode (one type of development nonperformance mode) is a mode in which the toner is separated and collected from the surface of the development roller 11, and is a mode in which the toner on the surface of the development roller 11 is replaced and the adherence of the toner to the development roller 11 is prevented.

In the development performance mode, the high-voltage power supply portion 8 first applies an alternating-current voltage that is a predetermined peak-to-peak voltage to the development roller 11. In the development performance mode, in order to replenish the toner to the development roller 11, the development roller bias portion 84 and the magnetic roller bias portion 85 output direct-current voltages such that the output voltage value of the development roller bias portion 84 is less than the output voltage value of the magnetic roller bias portion 85. In other words, the formula "the output voltage of the magnetic roller bias portion 85>the output voltage of the development roller bias portion 84" is satisfied. In this way, the positively charged toner is easily moved from the magnetic roller 12 toward the development roller 11.

Then, the first mode is a mode in which, before the printing, the thin layer of the toner is formed on the circumferential surface of the development roller 11. Hence, it is necessary to apply a bias such that the charged toner is moved from the magnetic roller 12 to the development roller 11. Thus, as in the development performance mode, the development roller bias portion 84 and the magnetic roller bias portion 85 output direct-current voltages such that the output voltage value of the development roller bias portion 84 is less than the output voltage value of the magnetic roller bias portion 85. In the first mode, an alternating-current voltage having a peak-to-peak voltage for the first mode may be applied to the development roller 11.

The second mode is a mode in which the toner is separated from the circumferential surface of the development roller 11 and is collected to the side of the magnetic roller 12. Hence, it is necessary to apply a bias such that the toner is easily moved from the development roller 11 toward the magnetic roller 12. Thus, as in the second mode, the development roller bias portion 84 and the magnetic roller bias portion 85 output direct-current voltages such that the output voltage value of the development roller bias portion 84 is more than the output voltage value of the magnetic roller bias portion 85. In this way, the positively charged toner is moved from the development roller 11 toward the magnetic roller 12. In the second mode, an alternating-current voltage having a peak-to-peak voltage for the second mode may be applied to the development roller 11.

After a time period during which one revolution of the development roller 11 is performed has elapsed since the mode is changed to the first mode or the second mode, the mode is transferred to another mode. In other words, at least during one revolution of the development roller 11, the first mode or the second mode is continued.

The control portion 7 inputs, according to the state of the printer 100, a signal indicating the mode to the output control portion 80, the development roller bias portion 84 and the magnetic roller bias portion 85. The development roller bias portion 84 and the magnetic roller bias portion 85 switch the magnitude of the output voltage value according to the indicated mode.

FIG. 5 shows three types of mode transition examples. First, in the uppermost row of FIG. 5, the transition of the state where only one sheet is printed is shown. When only one sheet is printed, the control portion 7 controls the high-voltage power supply portion 8 to change the mode of the developing device 1 from the state of no application before the start of the development to the first mode, and forms the thin layer of the toner on the surface (sleeve 11*c*) of the development roller 11. Thereafter, the control portion 7 controls the high-voltage power supply portion 8 to change the mode of the developing device 1 to the development performance mode, and continues the replenishment of the toner from the magnetic roller 12 to the development roller 11. Then, when the development (printing) is completed, the control portion 7 controls the high-voltage power supply portion 8 to change the mode of the developing device 1 to the second mode, and collects the toner from the development roller 11. Thereafter, the developing device 1 is brought into the state of no application.

Then, in the middle row of FIG. 5, the transition of the state where a plurality of pages are continuously printed in the range of 25 sheets or less is shown. The process before the start of the development is the same as when only one sheet is printed. When the development of the toner image corresponding to the first page is started, the control portion 7 controls the high-voltage power supply portion 8 to change the mode of the developing device 1 to the first mode between the sheets. Hence, the first mode and the development performance mode are repeated. Then, when the development (printing) in a job is completed, the control portion 7 controls the high-voltage power supply portion 8 to change the mode of the developing device 1 to the second mode. Thereafter, the developing device 1 is brought into the state of no application.

Then, in the bottom row of FIG. 5, the transition of the state where a plurality of pages in the range of 25 sheets or more are continuously printed is shown. The process before the start of the development is the same as when only one sheet is printed. When the development of the toner image corresponding to the first page is started, as a rule, the control portion 7 controls the high-voltage power supply portion 8 to change the mode of the developing device 1 to the first mode between the sheets. Hence, the first mode and the development performance mode are repeated. Then, after the printing of 25 sheets is performed, the control portion 7 controls the high-voltage power supply portion 8 to change the mode of the developing device 1 to the second mode, and refreshes(removes) the toner on the circumferential surface of the developing device 1. When 51 sheets or more are continuously printed, the second mode is performed each time 25 sheets are printed. After the second mode, the control portion 7 again controls the high-voltage power supply portion 8 to change the mode of the developing device 1 to the first mode, and thereafter the development is restarted. When the development (printing) is completed, the control portion 7 controls the high-voltage power supply portion 8 to change the mode of the developing device 1 to the second mode. Thereafter, the developing device 1 is brought into the state of no application. Although, in the present description, the example where the second mode is performed with reference to 25 sheets are shown, the reference is not limited to 25 sheets, and the reference may be 26 sheets or more or may be 24 sheets or less.

(Duty Ratio in Each Mode)

Figure 6:
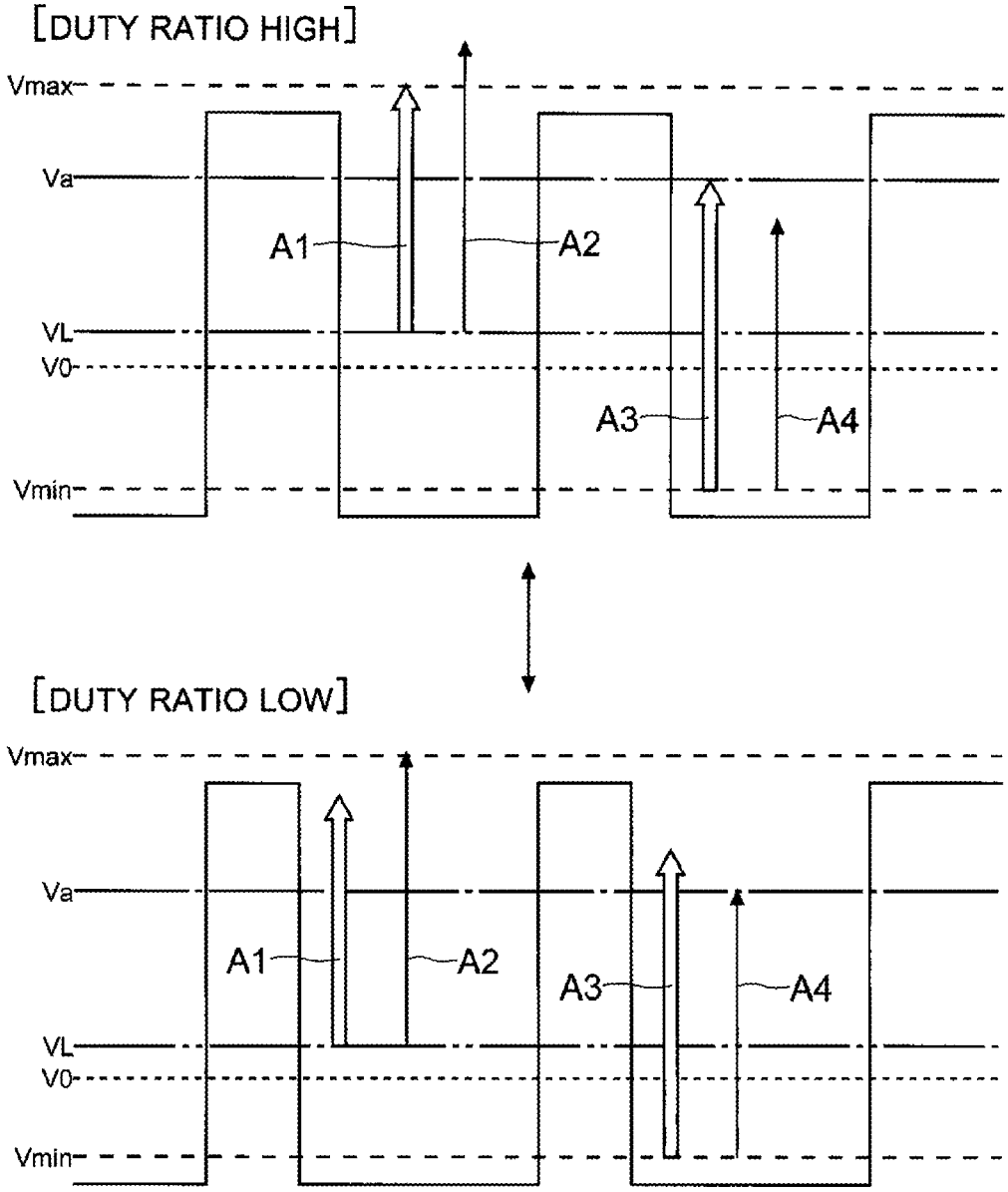
FIG. 6 is a diagram illustrating effects caused by the difference between duty ratios.

A mode of voltage application in the developing device 1 of the present embodiment and the change of a duty ratio will now be described with reference to FIG. 6. FIG. 6 is a diagram illustrating effects caused by the difference between the duty ratios.

In the printer 100 of the present embodiment, the duty ratio of an alternating-current voltage applied to the development roller 11 is changed. Specifically, the output control portion 80 changes the duty ratio of the switching of the transistor 81 according to the mode of the developing device 1. Then, in the development performance mode, the output control portion 80 increases the duty ratio in the switching of the transistor 81 as compared with the first mode and the second mode. The output control portion 80 makes the duty ratios in the first mode and the second mode less than the duty ratio in the development performance mode.

Differences in the blowing of the toner according to the duty ratio will first be described with reference to FIG. 6. A duty ratio in a timing chart on the upper side of FIG. 6 is higher than a duty ratio in a timing chart on the lower side. In FIG. 6, the duty ratio in the timing chart on the upper side is about 40%, and the duty ratio in the timing chart on the lower side is about 30%.

In each of the timing charts of FIG. 6, solid lines represent a waveform (a waveform obtained by stepping up a waveform produced by the switching of the transistor 81 of the output control portion 80) indicating variations in the voltage applied to the development roller 11. Hence, the vertical axis of each of the timing charts represents the amplitude of the voltage. The peak-to-peak voltage of this waveform is set within a range of 1 kV to 2 kV. In FIG. 6, V0 (line represented by a broken line) is 0 volts (ground).

The capacitor 82 removes a direct-current component. Hence, in the peak-to-peak voltage of the waveform indicating variations in the voltage applied to the development roller 11, the position of the line of V0 is a position (area center) in which the product of a time period of high level and an amplitude and the product of a time period of low level and an amplitude in one revolution are equal to each other. For example, when the duty ratio in a rectangular wave is 50%, and the peak-to-peak voltage is 1000 volts, a potential difference from the line of V0 to the peak on the positive side and a potential difference from the line of V0 to the peak on the negative side each are 500 volts. When the duty ratio in a rectangular wave is 40%, and the peak-to-peak voltage is 1000 volts, a potential difference from the line of V0 to the peak on the positive side is 600 volts and a potential difference from the line of V0 to the peak on the negative side is 400 volts.

The line of VL (line represented by an alternate long and two short dashes line) in each of the timing charts of FIG. 6 indicates the potential (for example, about 100 to 200 volts) of the photoconductor drum 42 after the exposure. The line of Va (line represented by an alternate long and short dash line) in each of the timing charts of FIG. 6 indicates the potential (for example, about 400 to 600 volts) of the photoconductor drum 42 at the time of the charging. Furthermore, the line of Vmax (upper one among long-pitch broken lines) in each of the timing charts of FIG. 6 indicates the peak value on the positive side of a voltage applied to the development roller 11 when biasing is performed by the development roller bias portion 84. The line of Vmin (lower one among the long-pitch broken lines) in each of the timing charts of FIG. 6 indicates the peak value on the negative side of a voltage applied to the development roller 11 when biasing is performed by the development roller bias portion 84.

When the development is performed, the positively charged toner is blown from the development roller 11 to a portion exposed in the photoconductor drum 42. Hence, as the difference between the potential (VL) of the photoconductor drum 42 and a potential at Vmax after the exposure is increased, an electrostatic force exerted on the toner is increased, with the result that the speed of movement of the toner is increased.

Here, as shown in FIG. 6, in terms of the area center, the difference (indicated by a solid line arrow A2 in FIG. 6) between the potential (VL) of the photoconductor drum 42 and the potential at Vmax after the exposure when the duty ratio is low is higher than the difference (indicated by a white-colored arrow A1 in FIG. 6) between the potential (VL) of the photoconductor drum 42 and the potential at Vmax after the exposure when the duty ratio is high. Hence, as the duty ratio is lower, it is possible to more abruptly blow the toner and rapidly place it on exposed dots. Therefore, it is said that, as the duty ratio is lower, the reproducibility of one dot is enhanced.

However, it is known from experiences that, as the duty ratio is lower, unevenness in the toner image developed are more likely to be produced. For example, when a solid image in the same concentration is printed, as the duty ratio is lower, unevenness in density are more likely to be produced in the result of the printing (which may be called "development drive unevenness"). Although the mechanism of the occurrence of the development drive unevenness is not completely clarified, errors in the manufacturing and attachment are present in the development roller 11 and the photoconductor drum 42, the length of a gap between the photoconductor drum 42 and the development roller 11 is not equal in any place in the direction of the shaft line and furthermore the rotation causes variations in the gap. It is thought that, as the reproducibility of one dot is enhanced (as the duty ratio is decreased), unevenness in the image formed by variations in the gap are produced.

On the other hand, it is known from experiences that, as the duty ratio is increased, a leak (electric discharge) is more likely to be produced. Since the gap between the photoconductor drum 42 and the development roller 11 is significantly small (1 mm or less), as the potential difference between the photoconductor drum 42 and the development roller 11 is increased, a leak is more likely to be produced.

Here, in the developing device 1 of the present embodiment, when the voltage applied to the development roller 11 is decreased, a leak is more likely to be produced. Then, as the peak voltage on the negative side applied to the development roller 11 is lower (becomes more negative), a leak is more likely to be produced. There is a possibility that, as the charging characteristic of the toner, the charging characteristic of the photoconductor drum 42 and the like cause the voltage applied to the development roller 11 to be increased, a leak is more likely to be produced.

Here, as shown in FIG. 6, in terms of the area center, the difference (indicated by a white-colored arrow A3 in FIG. 6) between the potential (Va) of the photoconductor drum 42 after the charging and a potential (Vmin) at the peak on the negative side of the voltage applied to the development roller 11 when the duty ratio is high is higher than the difference (indicated by a solid line arrow A4 in FIG. 6) between the potential (Va) of the photoconductor drum 42 after the charging and the potential (Vmin) at the peak on the negative side of the voltage applied to the development roller 11 when the duty ratio is low. In other words, as the duty ratio is higher, in the developing device 1 of the present embodiment, a leak (electric discharge) is more likely to be produced.

When a leak is produced, it is likely that the potential of the photoconductor drum 42 is decreased and the toner is adhered. When the toner is adhered to the photoconductor drum 42 at a time other than the time at which the development is performed, the intermediate transfer belt 52 and the secondary transfer roller 57 may be stained with the toner. Thus, it is likely that the toner is adhered to the sheet, and thus the sheet is stained. Moreover, it is likely that, when a current at the time of leakage is high, a small hole is produced in the photoconductor drum 42, and thus the quality of a toner image which is thereafter formed is degraded.

Hence, in the printer 100 of the present embodiment, in order to reduce unevenness in the toner image to enhance the quality of the image, the output control portion 80 of the high-voltage power supply portion 8 increases, in the development performance mode, the duty ratio as compared with the first mode and the second mode. On the other hand, in order to prevent the occurrence of a leak, the output control portion 80 of the high-voltage power supply portion 8 decreases, in the first mode or the second mode, the duty ratio as compared with the development performance mode. In this way, the duty ratios in the development performance mode, the first mode and the second mode are previously determined.

The control portion 7 indicates the mode of the developing device 1 to the output control portion 80 according to the printing process, the state of the printer 100, the number of sheets to be printed and the like. When the exposure is started in the exposure device 41, the control portion 7 instructs the output control portion 80 to transfer to the development performance mode. When the exposure is completed in the exposure device 41, the control portion 7 instructs the output control portion 80 to transfer to the first mode or the second mode. The output control portion 80 changes the duty ratio according to the mode instruction by the control portion 7. Alternatively, the control portion 7 may feed a signal indicating the duty ratio itself to the output control portion 80, and the output control portion 80 may change the duty ratio according to the indication.

(Stepwise Changes in the Duty Ratio)

Figure 7:
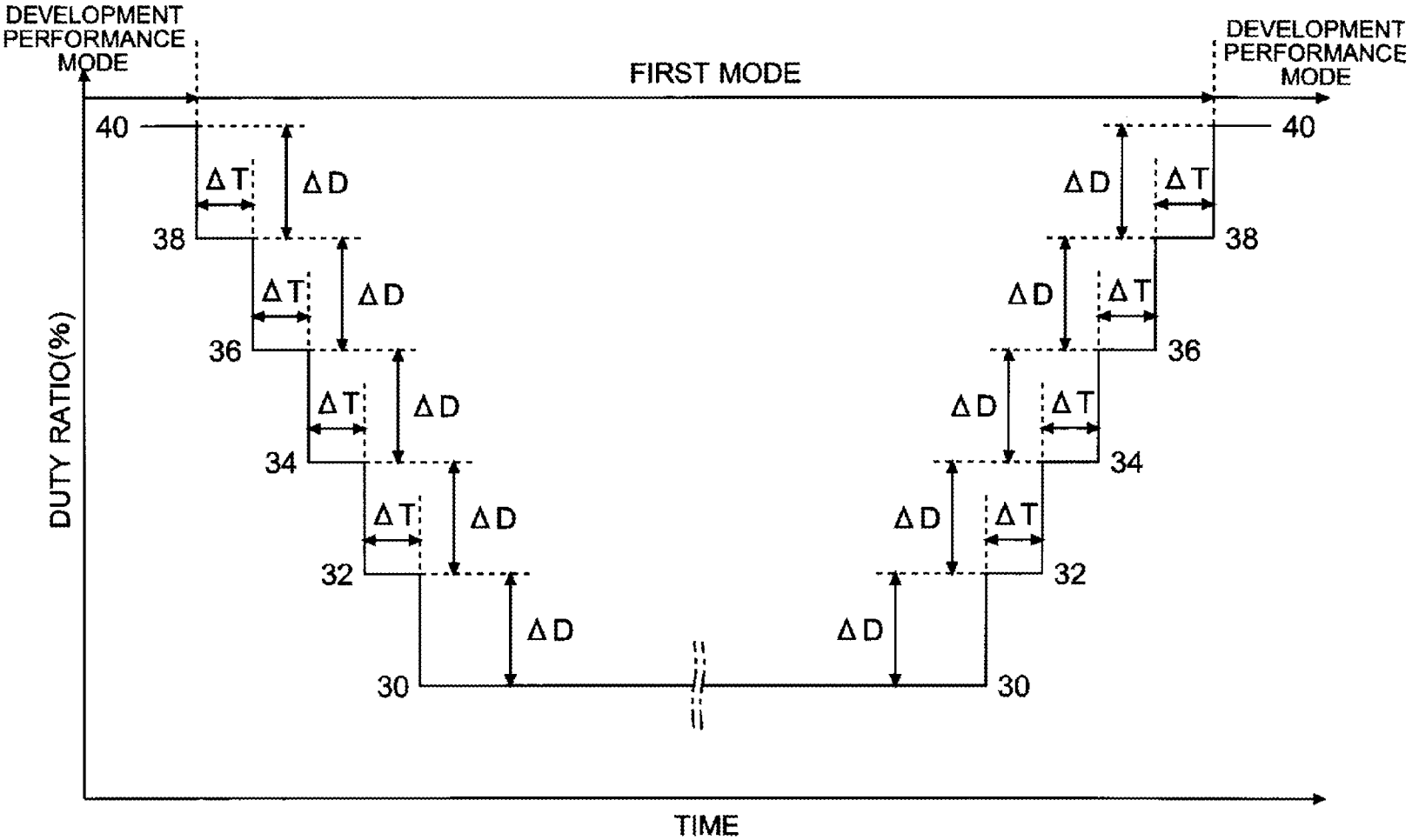
FIG. 7 is a diagram illustrating stepwise changes in the duty ratio.
Figure 8:
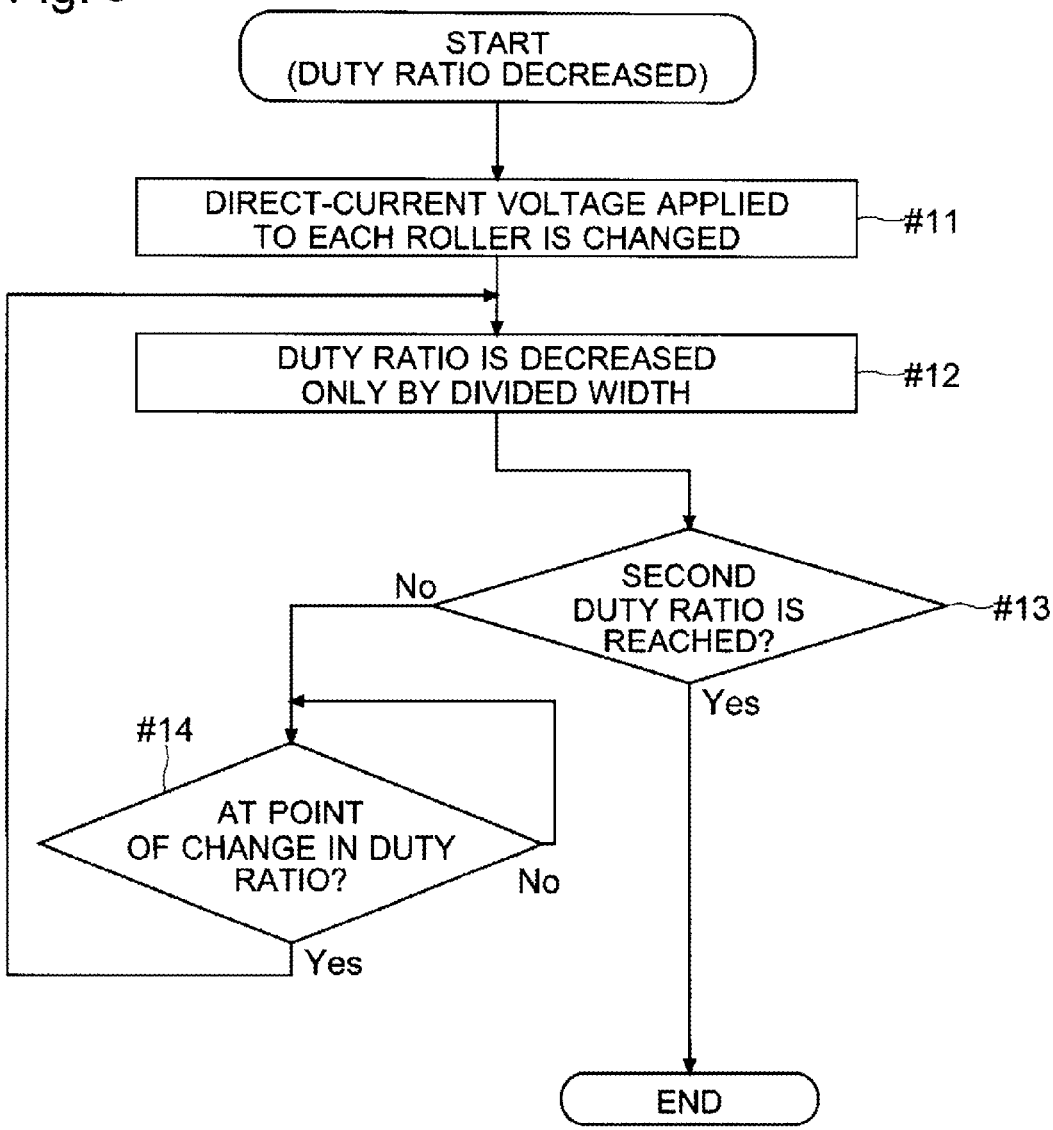
FIG. 8 is a flowchart showing the flow of processing for reducing the duty ratio.
Figure 9:
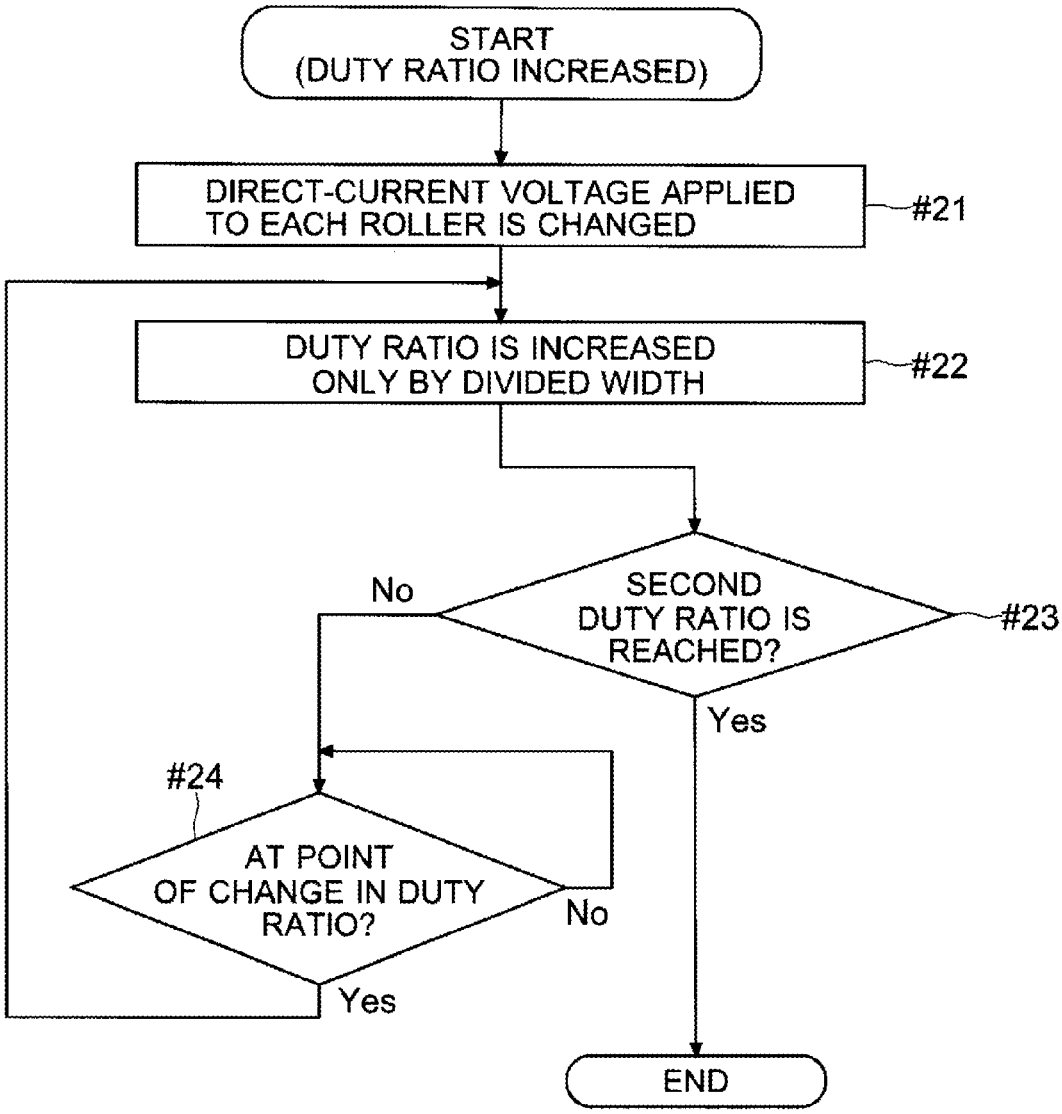
FIG. 9 is a flowchart showing the flow of processing for increasing the duty ratio.

Stepwise changes in the duty ratio in the present embodiment will now be described with reference to FIGS. 7 to 9. FIG. 7 is a diagram illustrating stepwise changes in the duty ratio. FIG. 8 is a flowchart showing the flow of processing for reducing the duty ratio. FIG. 9 is a flowchart showing the flow of processing for increasing the duty ratio.

In the present embodiment, the duty ratio is changed according to the mode. In the printer 100 of the present embodiment, the output control portion 80 sets the duty ratio at about 40% in the development performance mode whereas the output control portion 80 sets the duty ratio at about 30%, in the first mode and the second mode between the sheets before the performance of the development after the completion of the development. Although, in the description of the present embodiment, the duty ratios in the first mode and the second mode are equal to each other, a difference therebetween may be provided.

However, when the transformer 83 (coil) is used, the change of the duty ratio causes voltages asymmetric with respect to the positive and negative to be applied to the transformer 83. When voltages asymmetric with respect to the positive and negative are applied to the transformer 83, asymmetric magnetization occurs in the transformer 83, and the transformer 83 is brought into a state where a direct-current bias appears to be applied.

In particular, when an alternating-current voltage is applied to the transformer 83 with the asymmetric magnetization occurring, magnetic saturation is more likely to occur. When magnetic saturation occurs, in general, the impedance of the transformer 83 is derived from only a wire wound resistor, and thus a large current is passed therethrough. Thus, a large current is passed through the transistor 81 connected to the transformer 83 through the capacitor 82, with the result that the transistor 81 may be damaged.

As the amount of change in the duty ratio (the width of a change produced each time) is increased, the degree of asymmetric magnetization in the transformer 83 is increased. In a state where the degree of asymmetric magnetization is high, magnetic saturation is more likely to occur. For example, in the developing device 1 of the present embodiment, the duty ratio differs between the development performance mode and the first mode or the second mode by about 10%. Then, when the duty ratio is abruptly changed by 10%, the degree of asymmetric magnetization is increased.

On the other hand, when the change of the duty ratio causes asymmetric magnetization, the transformer 83 is brought into a state where the transformer 83 appears to be biased, and the potential between the capacitor 82 and the transformer 83 is temporarily changed. Then, resonance between the capacitor 82 and the transformer 83 causes the asymmetric magnetization to be gradually reduced as time passes while the potential between the capacitor 82 and the transformer 83 is being oscillated. Hence, the asymmetric magnetization of the transformer 83 tends to be reduced as time passes. As the degree of asymmetric magnetization is lower, the asymmetric magnetization tends to be eliminated more quickly.

Hence, in the developing device 1 of the present embodiment, the output control portion 80 stepwise changes the duty ratio, and changes it to the target of the duty ratio while reducing the amount of change in the duty ratio produced each time and reducing the asymmetric magnetization over a long time. Thus, the output control portion 80 can change the duty ratio without the transistor 81 being damaged by an overcurrent.

Hence, the change in the duty ratio will be described with reference to FIG. 7. The example of FIG. 7 shows the change in the duty ratio when the sheets are continuously printed and between the sheets the mode is changed from the development performance mode to the first mode and then to the development performance mode. The example of FIG. 7 shows that the duty ratio in the development performance mode is set at 40%, and the duty ratio in the first mode is set at 30%. The duty ratio is not limited to the example described above.

Here, the mode before being changed is referred to as a "first duty ratio." The target duty ratio (the duty ratio in the mode after being changed) is referred to as a "second duty ratio." In the example of FIG. 7, in the change in the duty ratio from the development performance mode to the first mode, the first duty ratio is 40%, and the second duty ratio is 30%. In the change in the duty ratio when the first mode is returned to the development performance mode, the first duty ratio is 30%, and the second duty ratio is 40%.

As shown in FIG. 7, when the first duty ratio (the first duty ratio in the current mode) is changed to the second duty ratio (the target duty ratio), the output control portion 80 changes the duty ratio while a predetermined time period (in FIG. 7, the predetermined time period is represented by $\Delta T$) is being acquired at divided widths (in FIG. 7, the divided width is represented by $\Delta D$) in which the transformer 83 does not produce magnetic saturation.

In the example of FIG. 7, the divided width is 2%. This divided width can be determined, by previously performing an experiment or the like, to be a value in which the transformer 83 does not produce magnetic saturation. The predetermined time period can be freely determined; the predetermined time period is so determined that such a current as to damage the transistor 81 by changing the duty ratio by the divided widths does not flow through the transistor 81. For example, the predetermined time period can be determined to be about a few milliseconds (two milliseconds) (the time period between the sheets is about 250 milliseconds).

As shown in FIG. 7, when the difference between the first duty ratio and the second duty ratio is 10% and the divided width is 2%, the output control portion 80 divides the duty ratio into five steps (changes it five times) to change the first duty ratio up to the second duty ratio. Although the number of steps may be six or more or may be any one of two to four, since the magnetic saturation is more unlikely to occur in the transformer 83 as the number of steps is increased, the number of steps is preferably five or more. When it takes an excessively long time to change the duty ratio from the first duty ratio to the second duty ratio, since it is impossible to perform processing between the modes such as the formation and adjustment of the thin layer of the toner on the development roller 11 until the mode is changed to the succeeding mode, the number of steps is preferably twenty or less.

The flow of processing when the duty ratio is decreased will now be described with reference to FIG. 8. In the developing device 1 of the present embodiment, processing when the development performance mode is transferred to the first mode or the second mode corresponds to processing when the duty ratio is decreased. In this case, the first duty ratio is the duty ratio (about 40%) in the development performance mode, and the second duty ratio is the duty ratio (about 30%) in the first mode or the second mode.

Hence, the start of FIG. 8 indicates a time when the control portion 7 inputs an instruction to change the mode from the development performance mode to the first mode or the second mode, to the output control portion 80, the development roller bias portion 84 and the magnetic roller bias portion 85.

When an instruction to change the mode to the first mode or the second mode is provided, the development roller bias portion 84 changes a direct-current voltage applied to the development roller 11, and the magnetic roller bias portion 85 changes a direct-current voltage applied to the magnetic roller 12 (step #11). When there is no necessity to change the bias between the development performance mode and the first mode, step #11 may not be necessary.

Then, the output control portion 80 decreases the duty ratio of the clock signal only by a predetermined divided width (step #12). While the duty ratio is changed from the first duty ratio to the second duty ratio, the divided width may be changed. Then, the output control portion 80 determines whether or not the duty ratio reaches the target duty ratio (the second duty ratio) (step #13).

When the duty ratio reaches the second duty ratio (yes in step #13), the present flow is completed (end). Then, until the output control portion 80 receives, from the control portion 7, an instruction to change the mode or an instruction to fail to apply a voltage, the output control portion 80 maintains the duty ratio and switches the transistor 81. On the other hand, when the duty ratio does not reach the second duty ratio (no in step #13), then the output control portion 80 continues to determine whether or not a time is reached when the duty ratio should be changed only by the divided width (changed stepwise) (from step #14, no in step #14→step #14). The output control portion 80 has a timer therewithin to have the function of measuring time. Then, the output control portion 80 determines whether or not, after the duty ratio was changed previous time, a time is reached the duty ratio should be changed only by the divided width. Here, a time period during which the time when the duty ratio is changed previous time and the time the duty ratio is changed next time only by the divided width is determined to be a predetermined time period or more such that the magnetic saturation does not occur. Then, when the time is reached when the duty ratio is changed only by the divided width (yes in step #14), the flow returns to step #12.

The flow of processing when the duty ratio is increased will now be described with reference to FIG. 9. In the developing device 1 of the present embodiment, processing when the first mode is transferred to the development performance mode corresponds to processing when the duty ratio is increased. When the duty ratio is increased, the first duty ratio is the duty ratio (about 30%) in the first mode, and the second duty ratio is the duty ratio (about 40%) in the development performance mode.

Hence, the start of FIG. 9 indicates a time when the control portion 7 inputs an instruction to change the mode from the first mode to the development performance mode, to the output control portion 80, the development roller bias portion 84 and the magnetic roller bias portion 85.

When an instruction to change to the development performance mode is provided, the development roller bias portion 84 changes a direct-current voltage applied to the development roller 11, and the magnetic roller bias portion 85 changes a direct-current voltage applied to the magnetic roller 12 (step #21). When there is no necessity to change the direct-current voltage (bias) between the development performance mode and the first mode, step #21 may not be necessary.

Then, the output control portion 80 increases the duty ratio of the clock signal only by a predetermined divided width (step #22). While the duty ratio is changed from the first duty ratio to the second duty ratio, the divided width may be changed. Since the degree of asymmetric magnetization can differ between when the duty ratio is increased and when the duty ratio is decreased, the magnitude (the amount of change in the duty ratio in each step) of the divided width may be different between the time when the duty ratio is increased and the time when the duty ratio is decreased. Then, the output control portion 80 determines whether or not the duty ratio reaches the target duty ratio (the second duty ratio) (step #23).

When the duty ratio reaches the second duty ratio (yes in step #23), the present flow is completed (end). Then, until the output control portion 80 receives, from the control portion 7, an instruction to change the mode, the output control portion 80 maintains the duty ratio and switches the transistor 81. On the other hand, when the duty ratio does not reach the second duty ratio (no in step #23), then the output control portion 80 continues to determine whether or not a time is reached when the duty ratio should be changed only by the divided width (changed stepwise) (from step #24, no in step #24→step #24). Since this point is the same as in step #14, its description will not be repeated.

As described above, the developing device 1 of the present embodiment includes: the development roller 11 which bears the toner and is opposite the photoconductor drum 42; the magnetic roller 12 which is arranged opposite the development roller 11 and performs, with the magnetic brush, the supply of the toner to the development roller 11 and the removal of the toner from the development roller 11; the transformer 83 which generates an alternating-current applied to the development roller 11; the switching portion (transistor 81) which passes and interrupts a current to the transformer 83; the output control portion 80 which stepwise changes the duty ratio a plurality of times from a first duty ratio to a second duty ratio; when the duty ratio in the switching performed by the switching portion is changed from the first duty ratio to the second duty ratio; and the capacitor 82 in which one end is connected to the transformer 83 and the other end is connected to the switching portion.

Although energy is somewhat oscillated by the capacitor 82 and the transformer 83, the asymmetric magnetization (the displacement of the magnetic flux) in the transformer 83 produced by changing the duty ratio tends to be decreased as time passes and be eliminated (the asymmetric magnetization tends to be removed). As the amount of change in the duty ratio is lower, the degree of asymmetric magnetization is lower, and it takes a shorter time for the asymmetric magnetization to be eliminated.

Hence, when the output control portion 80 changes the duty ratio in the switching from the first duty ratio to the second duty ratio, the output control portion 80 stepwise changes the duty ratio a plurality of times from the first duty ratio to the second duty ratio. Thus, it is possible to change the duty ratio little by little (stepwise). Hence, as compared with the case where the duty ratio is directly changed from the first duty ratio to the second duty ratio, the degree of asymmetric magnetization in the transformer 83 can be reduced. It is also possible to reduce the decrease in the impedance of the transformer 83 and prevent a large current (overcurrent) from flowing through the switching portion, with the result that the switching portion is prevented from being damaged.

Furthermore, since an appropriate duty ratio for preventing unevenness in the toner image is used or a duty ratio in which no leak between the development roller 11 and the photoconductor drum 42 is produced is used, it is possible to arbitrarily change the duty ratio without any problem. Thus, it is possible to provide the developing device 1 that can cause no leak and obtain a high-quality image having lesser.

The output control portion 80 changes the duty ratio from the first duty ratio to the second duty ratio while a predetermined time period is being acquired at divided widths in which no magnetic saturation is produced in the transformer 83. Thus, it is reliably possible to change the duty ratio such that no magnetic saturation is produced in the transformer 83. Since at least a predetermined time period has elapsed since the change of the duty ratio, and thereafter the succeeding stepwise change in the duty ratio is made, a time period during which asymmetric magnetization produced by the change of the duty ratio is eliminated is acquired. Hence, it is possible to reliably prevent the switching portion from being damaged by the passage of a large current caused by the change of the duty ratio.

During the printing, when the duty ratio is higher, unevenness in the toner image may be appropriately removed. On the other hand, in a state where the printing is not performed, when the duty ratio is lower, a leak may be unlikely to be produced such as by the exposure of the surface of the development roller 11 caused by the removal of the toner. Hence, the control portion 7 (output control portion 80) makes the duty ratio in the development performance mode in which the electrostatic latent image formed on the photoconductor drum 42 is developed differ from the duty ratio in the development nonperformance mode in which the electrostatic latent image formed on the photoconductor drum 42 is not developed. The duty ratio in the development performance mode is higher than that in the development nonperformance mode. When the development performance mode is transferred to the development nonperformance mode, the output control portion 80 sets the duty ratio in the development performance mode at the first duty ratio and sets the duty ratio in the development nonperformance mode at the second duty ratio, and thereby changes the duty ratio. When the development nonperformance mode is transferred to the development performance mode, the output control portion 80 sets the duty ratio in the development nonperformance mode at the first duty ratio and sets the duty ratio in the development performance mode at the second duty ratio, and thereby changes the duty ratio. This makes it possible to appropriately remove unevenness in the toner image and also makes it difficult for a leak to occur.

The developing device 1 of the present embodiment includes: the development roller bias portion 84 that applies a direct-current voltage to the development roller 11 to bias it and the magnetic roller bias portion 85 that applies a direct-current voltage to the magnetic roller 12 to bias it. As the development nonperformance mode, by changing the output from the development roller bias portion 84 and the magnetic roller bias portion 85, the first mode in which perform the supply of the toner to the development roller 11 and removal of the toner from the development roller 11 and the second mode in which the amount of toner supplied to the development roller 11 is reduced as compared with the first mode to provide a higher priority to the removal of the toner from the development roller 11 are present. When the printing is completed or when a predetermined number of sheets are continuously developed, the development roller bias portion 84 and the magnetic roller bias portion 85 apply a voltage in the second mode, and apply a voltage in the first mode before transfer to the development performance mode. Thus, when the printing is completed or when a predetermined number of sheets are continuously developed, it is possible to temporarily remove, in the second mode, the toner on the development roller 11 and refresh it. Hence, the adherence of the toner to the development roller 11 is prevented, and thus it is possible to maintain a high image quality.

In the present embodiment, the switching portion includes the transistor 81. Thus, even when the duty ratio is changed, a large current does not flow through the transistor 81. Consequently, it is possible to prevent the transistor 81 from being damaged.

When the duty ratio in the switching is changed from the first duty ratio to the second duty ratio, the number of steps from the first duty ratio to the second duty ratio is equal to or more than five but is equal to or less than twenty. In other words, when the output control portion 80 changes the duty ratio in the switching from the first duty ratio to the second duty ratio, the output control portion 80 stepwise changes the duty ratio in the range of steps of five or more but 20 or less. Thus, the switching portion is prevented from being damaged by a large current caused by the change of the duty ratio.

The predetermined time period described above is a time period during which such a current as to damage the switching portion(transistor 81) even when the duty ratio is changed at the divided width described above does not flow through the switching portion. Thus, the duty ratio is stepwise switched at such intervals that the switching portion is prevented from being damage by a large current caused by the change of the duty ratio.

The image forming apparatus (printer 100) includes the developing device 1 of the present embodiment. Thus, it is possible to provide an image forming apparatus in which there is no defect in the developing device 1, no unevenness in the toner image are produced, an image has a high quality and a leak produced causes no problem.

The present disclosure can be regarded as an disclosure of a method of controlling a developing device.

Although the above embodiment has been described using the example of the positively charged photoconductor drum 42 and the positively charged toner, the present disclosure can be applied to a case where a negatively charged photoconductor drum 42 and a negatively charged toner are used. Here, preferably, in a state (development performance mode) where a development for negative charging is performed, the duty ratio is determined so as to reduce the unevenness whereas, in a state (development nonperformance mode) where no development is performed, the duty ratio is determined so as to prevent the occurrence of a leak.

Although the present embodiment has been described, the scope of the present disclosure is not limited to the present embodiment; various modifications are possible without departing from the spirit of the disclosure.

What is claimed is:

1. A developing device comprising:

a development roller which carries a toner and which is opposite a photoconductor drum;

a magnetic roller which is arranged opposite the development roller and which performs, with a magnetic brush, supply of the toner to the development roller and separation of the toner from the development roller;

a transformer which generates an alternating-current voltage applied to the development roller;

a switching portion which passes and interrupts a current to the transformer;

an output control portion which stepwise changes, between sheets when sheets are continuously printed, from a first duty ratio to a second duty ratio, a duty ratio in switching by the switching portion a plurality of times; and a capacitor in which one end is connected to the transformer and the other end is connected to the switching portion, wherein the output control portion changes the duty ratio from the first duty ratio to the second duty ratio at divided widths in which no magnetic saturation is produced in the transformer while a predetermined time period is being acquired, a number of steps from the first duty ratio to the second duty ratio is equal to or more than five but is equal to or less than twenty when the duty ratio in the switching is changed from the first duty ratio to the second duty ratio, and the predetermined time period is a few milliseconds.

2. The developing device of claim 1, wherein the output control portion makes a duty ratio in a development performance mode in which an electrostatic latent image formed on the photoconductor drum is developed differ from a duty ratio in a development nonperformance mode in which the electrostatic latent image formed on the photoconductor drum is not developed, the duty ratio in the development performance mode is higher than the duty ratio in the development nonperformance mode, when the development performance mode is transferred to the development nonperformance mode, the output control portion sets the duty ratio in the development performance mode at the first duty ratio and the duty ratio in the development nonperformance mode at the second duty ratio so as to change the duty ratio, when the development nonperformance mode is transferred to the development performance mode, the output control portion sets the duty ratio in the development nonperformance mode at the first duty ratio and the duty ratio in the development performance mode at the second duty ratio so as to change the duty ratio.

3. The developing device of claim 2 further comprising:

a development roller bias portion that applies a direct-current voltage to the development roller to bias the development roller; and a magnetic roller bias portion that applies a direct-current voltage to the magnetic roller to bias the magnetic roller, wherein by changing the development roller bias portion and the magnetic roller bias portion outputs, a first mode for supplying the toner to the development roller, removal of the toner and a second mode in which an amount of the toner supplied to the development roller is reduced as compared with the first mode to provide a higher priority to the removal of the toner from the development roller are provided as the development nonperformance mode, the development roller bias portion and the magnetic roller bias portion apply voltage in the second mode when printing is completed or when a predetermined number of sheets are continuously developed and apply a voltage in the first mode before transfer to the development performance mode.

4. The developing device of claim 1, wherein the switching portion includes a transistor.

5. The developing device of claim 1, wherein the predetermined time period is a time period during which such a current as to produce damage even when the duty ratio is changed at the divided widths does not flow through the switching portion.

6. An image forming apparatus comprising:

the developing device of claim 1.

7. A method of controlling a developing device comprising:

generating, by a transformer, an alternating-current voltage applied to a development roller;

passing and interrupting, by switching of a switching portion, a current to the transformer; and stepwise changing, between sheets when sheets are continuously printed, from a first duty ratio to a second duty ratio, a duty ratio in switching by the switching portion a plurality of times, wherein the duty ratio is changed from the first duty ratio to the second duty ratio at divided widths in which no magnetic saturation is produced in the transformer while a predetermined time period is being acquired, and wherein a number of steps from the first duty ratio to the second duty ratio is equal to or more than five but is equal to or less than twenty when the duty ratio in the switching is changed from the first duty ratio to the second duty ratio.

8. The method of controlling a developing device according to claim 7, wherein a duty ratio in a development performance mode in which an electrostatic latent image is developed being made to differ from a duty ratio in a development nonperformance mode in which the electrostatic latent image is not developed, the duty ratio in the development performance mode being made higher than the duty ratio in the development nonperformance mode, when the development performance mode is transferred to the development nonperformance mode, the duty ratio in the development performance mode is set, at the first duty ratio and the duty ratio in the development nonperformance mode is set at the second duty ratio so as to change the duty ratio, when the development nonperformance mode is transferred to the development performance mode, the duty ratio in the development nonperformance mode is set, at the first duty ratio and the duty ratio in the development performance mode is set at the second duty ratio so as to change the duty ratio.

9. The method of controlling a developing device according to claim 8, wherein a direct-current voltage is applied to the development roller to bias the development roller, a direct-current voltage is applied to the magnetic roller to bias the magnetic roller which is arranged opposite the development roller and which performs, with a magnetic brush, supply of the toner to the development roller and removal of the toner from the development roller, wherein by changing biases to the development roller and the magnetic roller, in a first mode of the development nonperformance mode, supplying the toner to the development roller and removing the toner from the development roller, in a second mode of the development nonperformance mode, reducing an amount of the toner supplied to the development roller as compared with the first mode and removing the toner from the development roller, wherein a voltage is applied to the development roller in the second mode when printing is completed or when a predetermined number of sheets are continuously developed and a voltage is applied to the development roller in the first mode before transfer to the development performance mode.

10. The method of controlling a developing device according to claim 7, wherein the switching portion includes a transistor.

11. The method of controlling a developing device according to claim 7, wherein the predetermined time period is a time period during which such a current as to produce damage even when the duty ratio is changed at the divided widths does not flow through the switching portion.

* * * * *